US005632109A

United States Patent [19]

Caudle

[11] Patent Number: 5,632,109

[45] Date of Patent: May 27, 1997

[54] METHOD AND APPARATUS FOR DIRECTING BACK FLASH IN A FIREARM

[76] Inventor: Carl E. Caudle, P.O. Box 6, Moses Lake, Wash. 98837

[21] Appl. No.: 554,973

[22] Filed: Nov. 13, 1995

[51] Int. Cl.[6] ..... F41C 7/00

[52] U.S. Cl. ..... 42/51; 42/83; 42/86; 42/75.01

[58] Field of Search ..... 42/51, 83, 86, 42/75.01; 89/193

[56] References Cited

U.S. PATENT DOCUMENTS

| | | | |
|---|---|---|---|
| 4,065,866 | 1/1978 | Eguizabal | 42/51 |
| 4,186,506 | 2/1980 | Pawlak et al. | 42/83 |
| 4,437,249 | 3/1984 | Brown et al. | 42/51 |
| 4,461,109 | 7/1984 | Eguizabal | 42/51 |
| 4,700,499 | 10/1987 | Knight | 42/51 |
| 4,715,139 | 12/1987 | Rodney, Jr. | 42/51 |
| 4,888,901 | 12/1989 | French et al. | 42/51 |
| 5,109,622 | 5/1992 | Echeberria | 42/69.02 |
| 5,133,143 | 7/1992 | Knight | 42/51 |

*Primary Examiner*—Charles T. Jordan
*Assistant Examiner*—Meena Chelliah
*Attorney, Agent, or Firm*—Stratton Ballew PLLC

[57] ABSTRACT

A muzzle loading firearm includes a receiver, a flash plate adjacent the rear end of the barrel, a downward extending then forward extending exhaust channel and a nipple across the exhaust passageway from the flash plate. The nipple has an ignition passageway which terminates in an output port which is not coaxially aligned with the rear port of the flash passage of the flash plate to prevent backflash from returning through the nipple. The nipple has a forward face which defines a concave arcuate surface in the exhaust channel for further directing the backflash away from the ignition passageway and into the exhaust channel. An exhaust tube, extending forwardly from the receiver for venting the exhaust gases in a safe direction. The exhaust channel and exhaust tube are formed of a material having a high convection coefficient for quickly cooling the exhaust gases.

20 Claims, 5 Drawing Sheets

METHOD AND APPARATUS FOR DIRECTING BACK FLASH IN A FIREARM

BACKGROUND OF THE INVENTION

1. Field of the Invention

The present invention relates to the field of firearms. More particularly, the invention pertains to apparatus and method for firing a firearm which ensures that the entire back flash is directed away from the user's face.

2. Description of the Prior Art

Firearms, particularly muzzle-loading type firearms are old and well known. The typical firearm includes a receiver, a barrel extending forward from the receiver and a trigger mechanism mounted to the receiver including a hammer mounted proximate the rear end of the receiver. The barrel has a bore therethrough and a chamber formed at the rear end thereof. In a pistol type of firearm a handle will generally be provided, extending downward from the receiver. In a rifle type of firearm generally a stock is provided extending rearward from the receiver.

One class of firearms known as muzzle-loader is characterized by the method of loading where a propellant charge and a projectile are each individually loaded through the bore and into the chamber of the barrel. In this class of firearms a separate source of ignition is provided for igniting the charge. Such a source of ignition may be as simple as a flint, or it may be an ignition cap which contains an ignitable substance, for example potassium chlorate, which ignites when struck by the hammer.

It is known to use a nipple to direct the ignition spark toward the charge. The nipple may have a seat for mounting the ignition cap thereto. An input port is located at the rearward end of the nipple, an output port is located at the forward end of the nipple. Generally, the output port has a smaller cross-sectional area than the input port.

On ignition of the propellant charge there is a rapid and large increase in pressure within the chamber. The large increase in pressure causes the projectile to be propelled down the length of the bore and out the barrel at a high velocity. At the same time, some of the hot gases and debris from the ignition is directed backward due to the inertia of the projectile. This backward directed component of the ignition process is termed back flash. Temperatures exceeding eight hundred degrees Fahrenheit, pressures between two thousand and eighteen thousand pounds per square inch and speeds of between five hundred and sixty and two thousand feet per second are typical characteristics associated with the back flash. The back flash presents a substantial risk of danger to the shooter. The back flash follows the path of least resistance, most often being back through the nipple. Traditionally, the outlet port of the nipple is located relatively close to the shooter's eyes, especially the shooter's sighting eye. The back flash and the accompanying hot gases can easily bum the shooter's eyes and face. It can also cause the ignition cap to fragment, the fragments presenting a grave risk of injury to the eyes and face of the shooter. At the very least the back flash presents a substantial annoyance to the shooter and a distinct probability of injury. As a consequence, much effort has been directed at minimizing and redirecting the back flash in an effort to make muzzle-loading guns safer.

Several attempts have been made to overcome the back flash problem. Some have tried to redirect the back flash. U.S. Pat. Nos. 5,109,622 issued to Echeberria and 4,715,139 to Rodney disclose the use of a downward directed port, proximate the inlet port of the nipple for releasing the back flash. U.S. Pat. No. 4,700,499 issued to Knight discloses a lateral port, proximate the outlet port of the nipple for releasing the back flash.

A further attempt at redirecting the back flash is shown in U.S. Pat. No. 4,888,901 issued to French. The French reference discloses the placement of a pair of lateral exhaust ports between the outlet of the nipple and a flash plate or breech plug. Examination and testing of the French design has revealed that significant dangers are still presented to the shooter. The location of the exhaust ports is still unacceptably close to the shooter's face, and presents a particular risk when the firearm is being discharged into a breeze. Also, a significant amount of backflash still escapes through the nipple where it exhausts proximate the shooter's face and eyes. A further problem arises from leakage of backflash between the receiver and the outside surface of the nipple.

These efforts have failed for several reasons. The attempts at redirecting back flash have not reduced the magnitude of the problem, rather they have simply moved the problem from one location on the firearm to another. All of the above cited efforts expel the back flash directly to the atmosphere. These attempted solutions still permit the back flash to follow a path through the nipple which causes the ignition passageway of the nipple to become clogged with debris such as carbon which requires increased time and effort to be spent in cleaning the firearm. It also leads to excessive cap fragmentation which can cause damage to the moving parts of the firearm in addition to the shooter. All of these attempted solutions continue to present a grave risk of injury to the shooter.

There is a demonstrated need in the field of firearm technology for a device which overcomes the aforementioned problems and provides a safe muzzle-loaded firearm in which the back flash is dissipated to some significant degree before it is exhausted and is exhausted away from the ignition cap and the shooter.

SUMMARY OF THE INVENTION

The present invention is a method and apparatus for dissipating back flash in a firearm before it is exhausted and exhausting or directing the back flash away from the shooter and the ignition source, and into a safe direction.

The firearm includes a receiver having a downward extending exhaust channel defined therein. A barrel having a longitudinal bore is mounted at its rear end to the receiver. A flash plate or breech plug is received in the receiver adjacent the rear end of the barrel. The flash plate has a rear port opening into the exhaust channel and a front port opening into the chamber of the barrel, the front and rear ports connected by a flash passageway. The flash plate may be retained in the receiver by threads or through friction or any other retaining means. A nipple is located behind the flash plate. The nipple has a rearward face and an input port. A seat is formed about the input port for mounting an ignition cap thereon. The nipple also has a forward face and an output port, which opens into the exhaust channel. The input and output ports are connected by an ignition passageway. The output port of the nipple may have a smaller cross-sectional area than the input port of the nipple. Unlike all previous designs, the output port of the nipple is not in axial alignment with the rear port of the flash plate. This prevents the backflash from simply following up the ignition passageway of the nipple.

An arcuate surface is formed on the forward face of the nipple which helps to redirect the backflash into a downward direction and along the exhaust channel. In addition to redirecting the backflash, the arcuate surface formed on the forward face of the nipple and the first elbow have the effect of slowing the backflash. A first elbow or corner is formed by the flash plate and the exhaust channel which also assists in redirecting the backflash. The cross-sectional area of the exhaust channel is large relative to the cross-sectional area of the rear port of the flash plate which gives rise to a Venturi effect. The Venturi effect draws air through the nipple and into the exhaust channel. This has the effect of i) causing the propellant and the back flash to burn more rapidly, and thereby dissipate more quickly, and ii) creating a one way flow through the nipple from input port to output port, such that the flow tends to resist any tendency of the back flash to flow back out of the nipple. Additionally, as the cross-sectional area increases there is a corresponding decrease in the velocity of the backflash, helping to dissipate the back flash.

The exhaust channel and the exhaust tube are constructed from materials having a high convection coefficient. This allows for a rapid reduction in the temperature of the back flash through convection with the exhaust channel and exhaust tube. In addition to the safety provided by lowering the temperature of the back flash, the rapid reduction in temperature also produces a corresponding pressure drop in the exhaust channel and the exhaust tube. An exhaust chamber is defined in the exhaust tube, preferably proximate its second or distal end. The exhaust chamber has a larger cross-sectional area than the exhaust tube, causing a further decrease in the energy of the back flash (temperature and pressure), ensuring that the back flash is almost wholly dissipated prior to being exhausted into the atmosphere. The low pressure condition in the exhaust channel causes the ignition cap to be retained on the nipple, partially closing off the inlet port of the nipple but still allowing air to flow through the nipple. The retention of the ignition cap on the seat of the nipple further reduces the likelihood of fragmentation of the ignition cap. While the blow of the hammer on the ignition cap will cause the ignition cap to split, the lack of back flash prevents the ignition cap from completely fragmenting. This permits the ignition cap to be easily removed after firing. As discussed above, the low pressure condition in the exhaust channel also directs the back flash away from the nipple and out the channel. Debris from the back flash and a fragmented ignition cap is thus eliminated, along with the danger presented by the heat of the back flash.

An additional benefit of this structure is an improvement in the burn characteristics of the propellant due to the increase in oxygen within the chamber of the barrel.

A first object of the invention is to provide a safe method of directing back flash from the ignition of a charge in a muzzle-loaded firearm away from the shooter and the ignition cap.

A second object of the invention is to direct the back flash outward from an exhaust tube in a safe direction.

A third object of the invention is to prevent the fragmentation of the ignition cap and to retain the ignition cap on the nipple.

A fourth object of the invention is to reduce the temperature and speed of the back flash before expelling the back flash to the atmosphere.

A fifth object of the invention is to provide more oxygen to the chamber of the firearm to improve the burn characteristics of the propellant charge.

DESCRIPTION OF THE PREFERRED EMBODIMENTS

Figure 1:
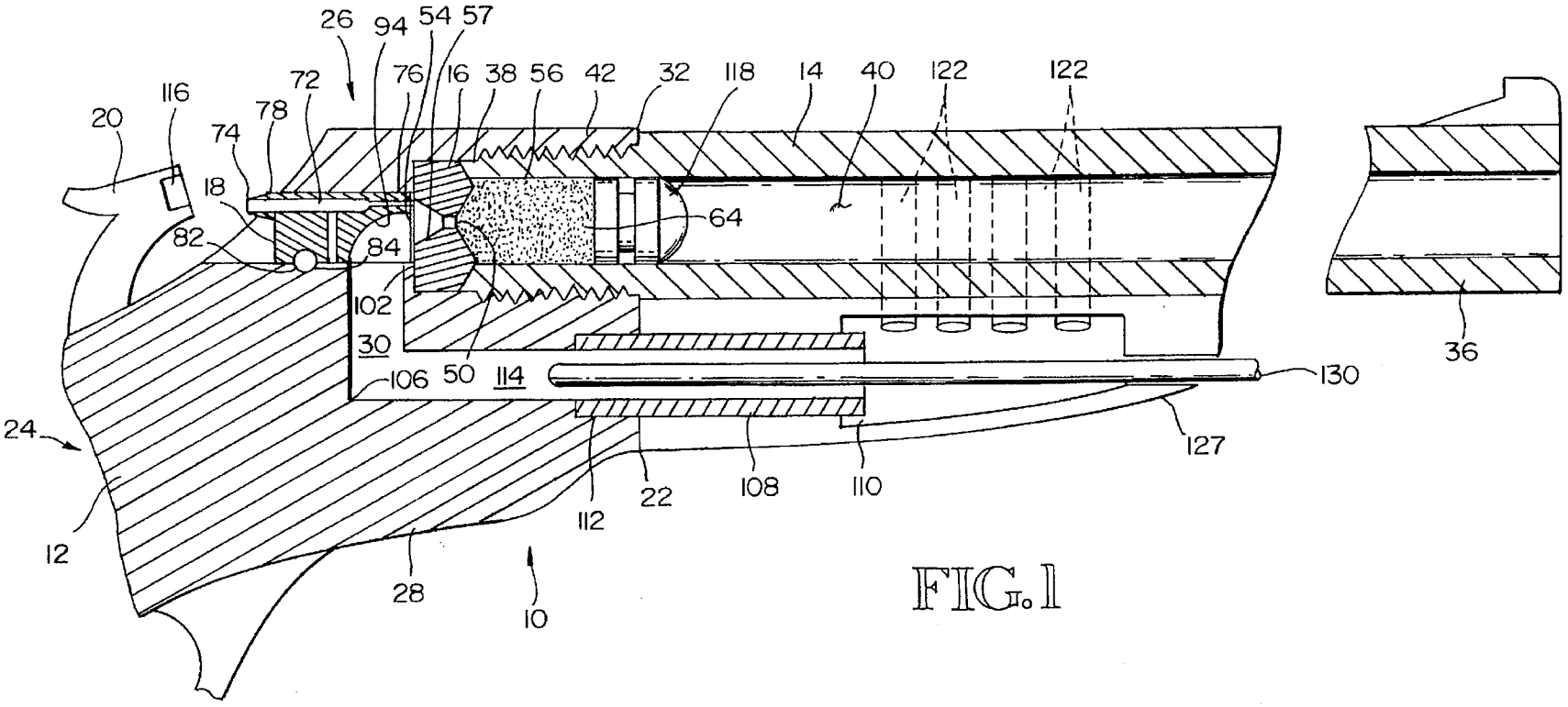
FIG. 1 is a cross-sectional view of the preferred embodiment of the invention having a charge and a projectile loaded in the chamber.

With reference to FIGS. 1, 5, 6 and 8, the firearm 10 is shown, the firearm 10 comprising a receiver 12, a barrel 14, a flash plate 16, a nipple 18 and a hammer 20. In the ensuing discussion and in the claims it should be understood that a flash plate 16 and a breech plug refer to the same structure which may be threaded for mounting in the barrel 14 (FIG. 8) or may be clamped into the receiver 12 or retained in the receiver 12 in any other manner.

With further reference to FIGS. 1, 5, 6 and 8, the receiver 12 has a forward end 22, a rearward end 24, an upper end 26, a lower end 28, and an exhaust channel 30 therein. The exhaust channel 30 may be integrally formed within the receiver 12 or may be a separate part mounted within the receiver 12. The receiver 12 has an opening 32 defined in the forward end 22 thereof which leads to the exhaust channel 30. In the preferred embodiment the opening 32 in the receiver 12 has an internal thread 34 therein.

The barrel 14 has a front end 36, a rear end 38 and a longitudinal barrel bore 40 therethrough extending between the front end 36 and the rear end 38. In the preferred embodiment the rear end 38 of the barrel 14 has an external thread 42 about its perimeter, for threadly mounting the rear end 38 of the barrel 14 into the opening 32 of the receiver 12. It is also preferred that the rear end 38 of the barrel 14 be tapered inward toward the longitudinal barrel bore 40 to form a concavity 44 on the rear end 38 of the barrel 14.

Figure 5:
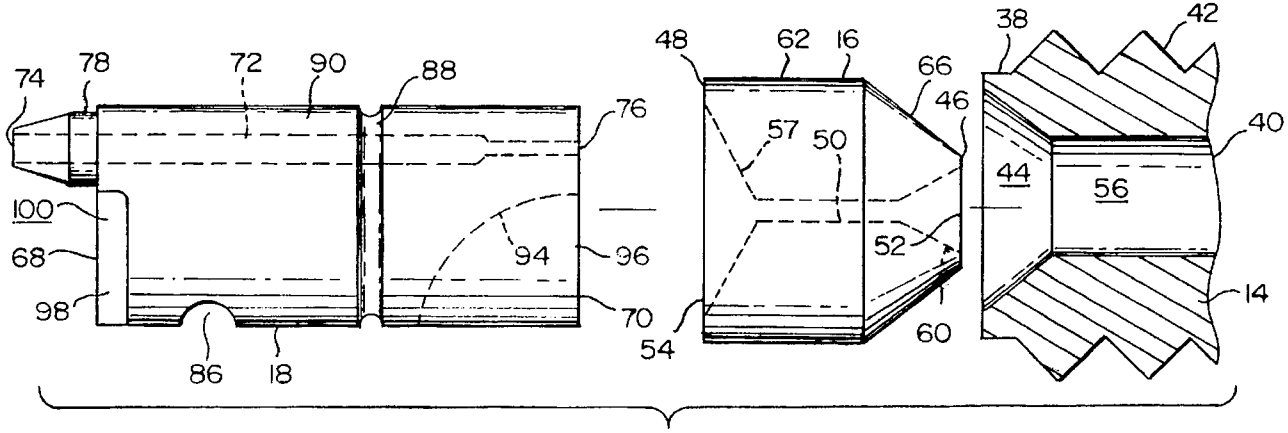
FIG. 5 is an exploded plan view of the nipple and flash plate with the barrel shown in cross-section.

With particular reference to FIG. 5, the flash plate 16 has a front face 46, a rear face 48, and a flash passageway 50 therethrough extending between the front face 46 and the rear face 48 of the flash plate 16. The flash passageway 50 defines a front port 52 on the front face 46 and a rear port 54 on the rear face 48 of the flash plate 16. The flash plate 16 is received in the receiver 12 adjacent the rear end 38 of the barrel 14. The front port 52 of the flash plate 16 opens into the chamber 56 defined by the bore 40 of the barrel 14. The rear port 54 of the flash plate 16 opens into the exhaust channel 30 of the receiver 12. It has been found that a flash passageway 50 diameter of from 0.04 inches to 0.06 inches produces satisfactory results.

Figure 3:
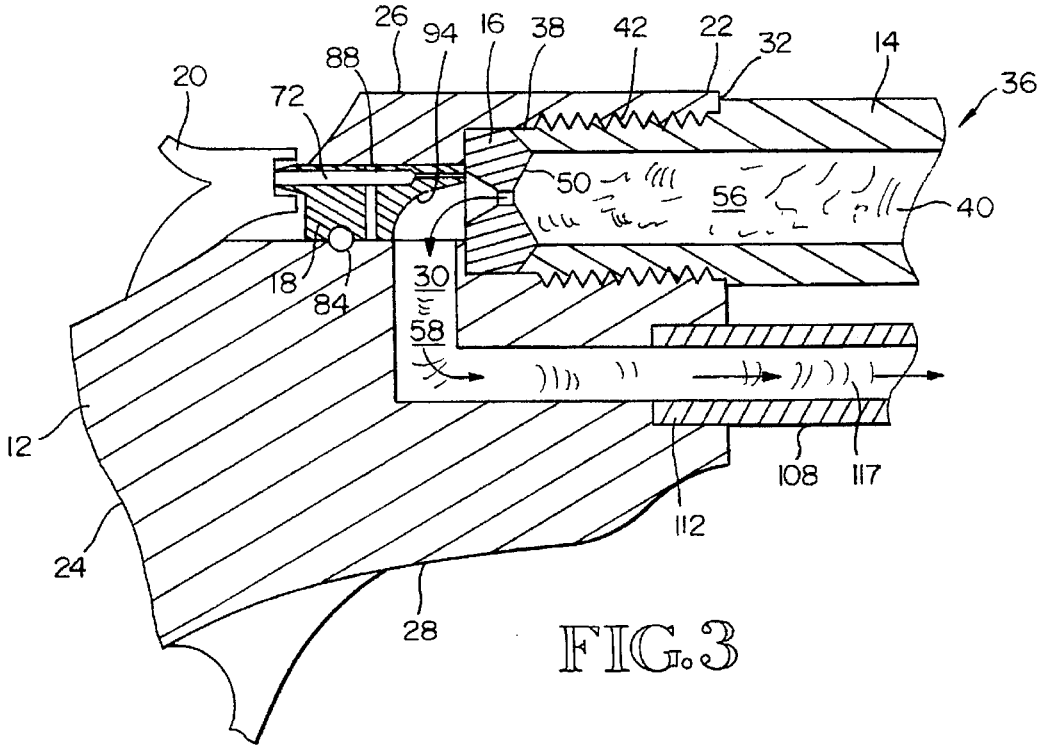
FIG. 3 is the cross-sectional view of FIG. 1 as the backflash from the ignition or the propellant charge enter the exhaust passage.
Figure 8:
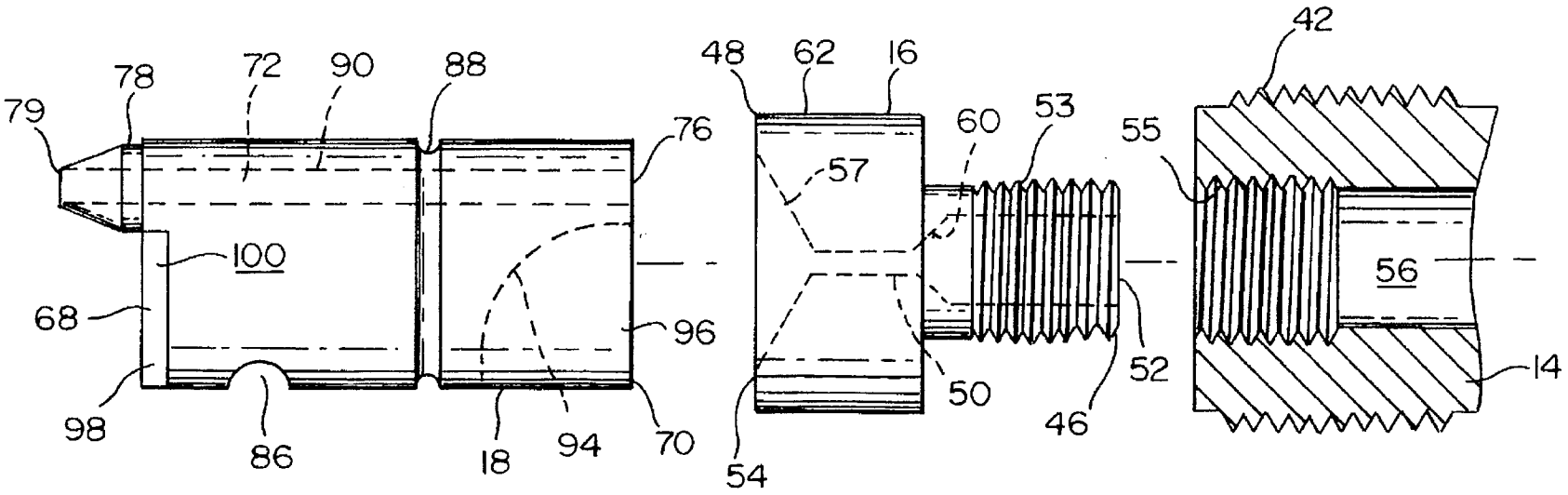
FIG. 8 is an exploded plan view of the nipple, threaded flash plate and barrel, the barrel shown in cross-section.

In the preferred embodiments, FIGS. 3, 5 and 8, the rear face 48 of the flash plate 16 has an ignition directing bevel 57 defined thereon, concentric about the rear port 54. The ignition directing bevel 57 tapers inward from the outer perimeter 62 of the flash plate 16 proximate the rear face 48 toward the rear port 54. The ignition directing bevel 57 serves to funnel the ignition inward to the flash passageway 50. The ignition directing bevel 57 also serves to dissipate the backflash 58 as it exits the flash passageway 50.

With particular reference to FIG. 5, an ignition locating bevel 60 is defined concentric about the front port 52 on the front face 46 of the flash plate 16. The ignition locating bevel 60 tapers outward from the front port 52 toward the outer perimeter 62 of the flash plate 16. The ignition locating bevel 60 directs the ignition into the propellant charge 64 for achieving more complete and efficient ignition of the propellant charge 64. The ignition locating bevel 60 also serves to funnel the backflash 58 from the ignition of the propellant charge 64 into the flash passageway 50 of the flash plate 16.

Also in the preferred embodiments, a barrel sealing bevel 66 is defined concentric about the ignition locating bevel 60 on the front face 46 of the flash plate 16. The barrel sealing bevel 66 securingly engages the rear end 38 of the barrel 14. The barrel sealing bevel 66 is particularly designed to provide a gas-tight sealing engagement with the tapered rear end 38 of the barrel 14 when the barrel 14 is threadly mounted in the opening 32 of the receiver 12. The barrel sealing bevel 66 also permits the flash plate 16 to be used with a large variety of barrel diameters.

With reference to FIG. 8, the flash plate or breech plug 16 has a front face 46, a rear face 48, and a flash passageway 50 therethrough extending between the front face 46 and the rear face 48 of the flash plate 16. The flash passageway 50 defines a front port 52 on the front face 46 and a rear port 54 on the rear face 48 of the flash plate 16. The flash plate 16 is received in the receiver 12 adjacent the rear end 38 of the barrel 14, the flash plate 16 threaded 53 for being secured within the chamber 56 of the barrel 14 which also carries a thread 55. The front port 52 of the flash plate 16 opens into the chamber 56 defined by the bore 40 of the barrel 14. The rear port 54 of the flash plate 16 opens into the exhaust channel 30 of the receiver 12. It has been found that a flash passageway 50 diameter of from 0.04 inches to 0.06 inches produces satisfactory results.

With further reference to FIG. 8, the ignition locating bevel 60 may alternatively be defined within the flash plate 16 between the front port 52 and the rear port 54. The barrel sealing bevel 66 may be perpendicular to the bore 40 of the barrel 14.

With reference to FIGS. 3, 5 and 8, the front face 46 of the flash plate 16 may be formed of a malleable material to provide a more complete sealing engagement with the rear end 38 of the barrel 14. This aids in preventing blowby through the joint formed between the barrel 14 and the flash plate 16. Brass is a preferred malleable material. The use of malleable material does however reduce the durability of the flash plate 16. A non-malleable material, such as stainless steel, has been successfully used to increase the durability of the flash plate 16. Alteratively, the flash plate 16 may simply be replaced when worn beyond its service life.

Figure 7:
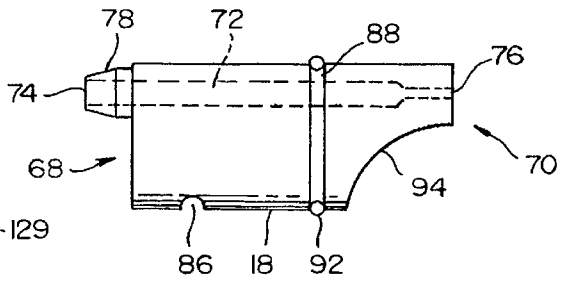
FIG. 7 is an elevational plan view of the nipple in the second preferred embodiment of the invention.

With reference to FIGS. 5 and 7, the nipple 18 has a rearward face 68, a forward face 70 and an ignition passageway 72 therethrough extending between the rearward face 68 and the forward face 70. The ignition passageway 72 defines an input port 74 on the rearward face 68 and an output port 76 on the forward face 70 of the nipple 18. The ignition input port 74 may have a larger cross-sectional area than the ignition output port 76, as shown in FIG. 5, or the cross-sectional area may remain constant throughout the nipple 18, as shown in FIG. 8. Also in the preferred embodiments, a seat 78 is defined about the input port 74 of the nipple 18. The diameter of the seat 78 is such that an ignition cap 80 may be secured thereon.

With reference to all of the figures, the nipple 18 is mounted in the receiver 12 such that the output port 76 of the nipple 18 opens into the exhaust channel 30 of the receiver 12 and the input port 74 protrudes out of the receiver 12. In the preferred embodiments, the nipple 18 is slidably received in the receiver 12 and retained therein by a nipple retaining pin 82 securingly received through a pin receiving hole 84 in the receiver 12 and a pin receiving aperture 86 in the nipple 18. This permits easy removal of the nipple 18 for cleaning the nipple 18, the exhaust channel 30 and the flash plate 16.

In the preferred embodiments, the nipple 18 has a relief 88 formed in its outer periphery 90, about the longitudinal axis of the nipple 18. In the first preferred embodiment, FIG. 5, grease (not shown) may be placed in the relief 88 for forming a seal between the outer periphery 90 of the nipple 18 and the receiver 12. Alternatively, as shown in the second preferred embodiment in FIG. 7, an O-ring 92 may be received in the relief 88 for forming the seal between the outer periphery 90 of the nipple 18 and the receiver 12.

Preferably, the output port 76 of the nipple 18 is spaced across the exhaust channel 30 from the rear port 54 of the flash plate 16. The output port 76 of the nipple 18 is staggered with respect to the rear port 54 of the flash plate 16 such that the output port 76 of the nipple 18 and the rear port 54 of the flash plate 16 are not in coaxial alignment (non-coaxial).

Preferably, an arcuate concave surface 94 is formed on the forward face 70 of the nipple 18. In the first preferred embodiment as shown in FIG. 5, the arcuate concave surface 94 is formed in a slot 96. In a second preferred embodiment as shown in FIG. 7, an entire portion of the forward face 70 of the nipple 18 defines the arcuate concave surface 94. When the nipple 18 is received in the receiver 12, the arcuate concave surface 94 forms part of the exhaust channel 30.

With reference to FIG. 5, a step 98 may be formed on the rearward face 68 of the nipple 18. The step 98 includes a pair of opposed surfaces 100 which permit the nipple 18 to be inserted and removed with a pair of pliers without causing damage to the nipple 18.

With reference to FIGS. 1–4 and 6, the exhaust channel 30 of the receiver 12 extends relatively downward in the receiver 12 from a point above the output port 76 of the nipple 18. The rear face 48 of the flash plate 16 and the exhaust channel 30 of the receiver 12 define a first elbow 102 having an included angle 104 of at least 90 degrees. With respect to FIGS. 1–4, the exhaust channel 30 can form a second elbow 106 spaced relatively below the first elbow 102 for turning the back flash 58 into a forward direction with respect to the receiver 12. The exhaust channel 30 has a relatively large cross-sectional area with respect to the output port 76 of the nipple 18 and the rear port 54 of the flash plate 16. It has been observed that an exhaust channel 30 diameter of 0.4375 inches produces good results. The exhaust channel 30 is preferably constructed of a material having a relatively high convection rate, such as a metal.

Figure 6:
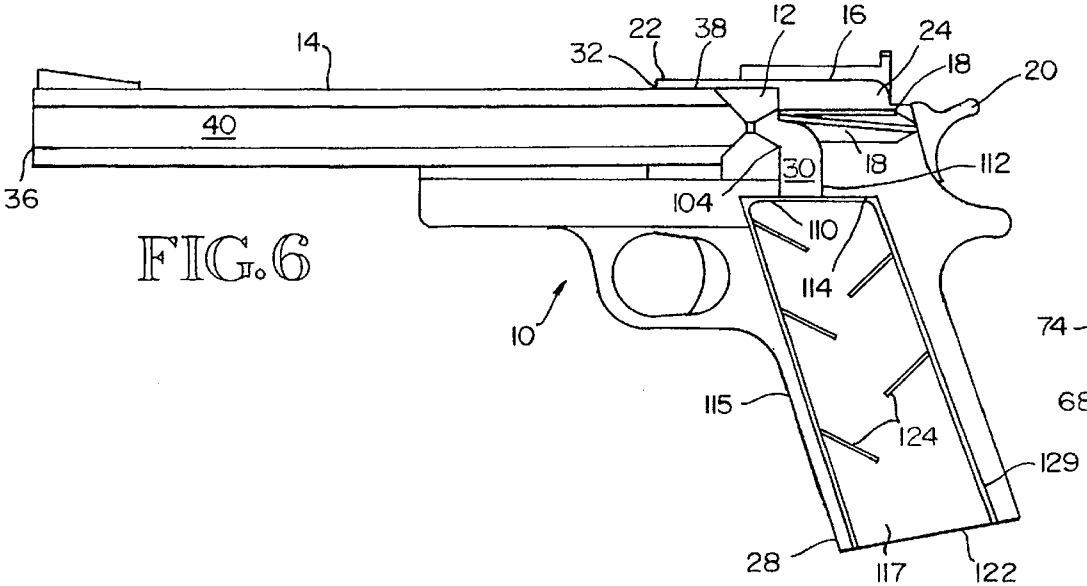
FIG. 6 is cross-sectional view of the invention as used in a pistol.

With reference to FIGS. 1–5 and 6, in both of the preferred embodiments, an exhaust tube 108 is provided, the exhaust tube 108 having a first end 110, a second end 112 and a longitudinal exhaust passage 114 therethrough. The second end 112 of the exhaust tube 108 is mountingly received by the receiver 12 such that the exhaust tube 108 preferably extends forwardly from the receiver 12 in the rifle versions, or downward, through the handgrip 115 in the pistol version of the invention. The exhaust passage 114 of the exhaust tube 108 is in communication with the exhaust channel 30 of the receiver 12 for venting the backflash 58 therethrough and eventually discharging the backflash 58 into the atmosphere. The exhaust tube 108 is preferably formed of a material having a relatively high convection coefficient, such as metals. An exhaust chamber 117, having a larger cross-sectional area than the rest of the exhaust passage 114 is defined proximate the second end 112 of the exhaust tube 108. In FIGS. 1–4 the exhaust chamber 117 is shown defined in the forearm 127 of the firearm 10, exhaust ports 122 are defined in the forearm 127 for venting the exhaust chamber 117. In FIG. 6 the exhaust chamber 117 is implemented as a magazine 129 removably received the handgrip 115 of the firearm 10, exhaust ports 122 are defined at the bottom of the magazine 129 for venting the exhaust chamber 117. With particular reference to FIG. 6, baffles 124 may be defined in the exhaust chamber 117 for assisting in the dissipation of the backflash 58. As is apparent from their purpose, the baffles 124 may be of any variety of shapes and orientations. The baffles 124 may be used in either embodiment of the firearm 10.

With reference to FIG. 6, a ram rod 130 may be received through a ram rod passage 132 defined in the forearm 127, such that the ram rod 130 extends through the ram rod passage 132, the exhaust chamber 117 and into the exhaust passage 144, when being stored. When stored, the ram rod 130 will aid in the dissipation of the backflash 58.

The hammer 20 preferably has a recess 116 formed therein for surrounding the ignition cap 80 and assisting in retaining the ignition cap 80 on the seat 78 of the nipple 18.

Figure 2:
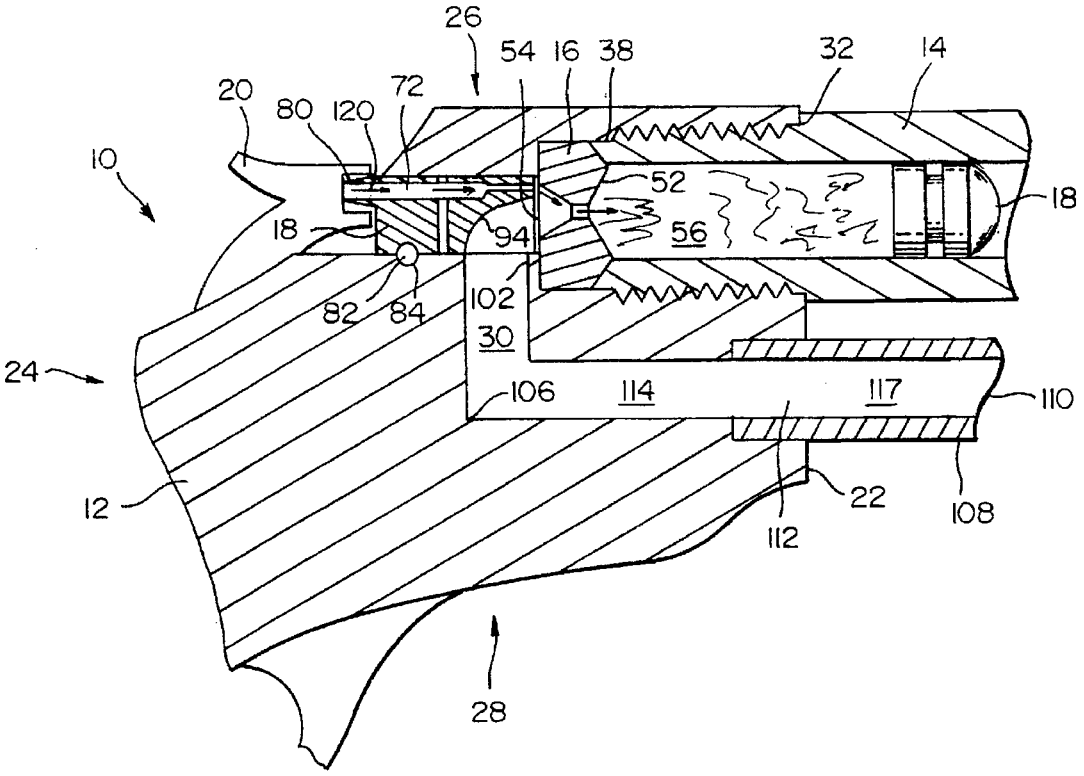
FIG. 2 is the cross-sectional view of FIG. 1 as the propellant charge ignites.

With reference to FIG. 1, the firearm 10 may be prepared for firing with a propellant charge 64 and a projectile 118 loaded into the chamber 56 of the barrel 14. An ignition cap 80 may be located onto the seat 78 of the nipple 18, proximate the input port 74 of the nipple 18. A conventional trigger mechanism is provided (not shown) for activating the hammer 20. With reference to FIG. 2, the hammer 20 strikes the ignition cap 80 causing the ignition cap 20 to ignite. The blow of the hammer 20 also causes the ignition cap 80 to partially split, but does not cause the ignition cap 80 to fragment. The split in the ignition cap 80 permits easy removal of the ignition cap 80 from the seat 78 of the nipple 18 after the firearm 10 has discharged.

With further reference to FIG. 2, the spark 120 generated from the ignition of the ignition cap 80 is then directed toward the propellant charge 64. The spark 120 first enters the input port 74 of the nipple 18 and passes through the ignition passageway 72 before exiting through the output port 76 of the nipple 18. The spark 120 then enters the exhaust channel 30 of the receiver 12, and is funneled by the ignition directing bevel 57 of the rear face 48 of the flash plate 16 into the rear port 54 of the flash plate 16. The spark 120 then passes through the flash passageway 50 and exits through the front port 52 of the flash plate 16.

Upon exiting the front port 52 of the flash plate 16 the spark 120 is directed into the propellant charge 64 by the ignition locating bevel 60 of the flash plate 16. With reference to FIG. 3, the spark 120 causes the propellant charge 64 to ignite, causing rapid combustion within the chamber 56 of the barrel 14 and generating a back flash 58. The rapid expansion of gases within the bore 40 of the barrel 14 causes the projectile 118 to be propelled through the bore 40 and expelled at high speed out the front end 36 of the barrel 14.

Figure 4:
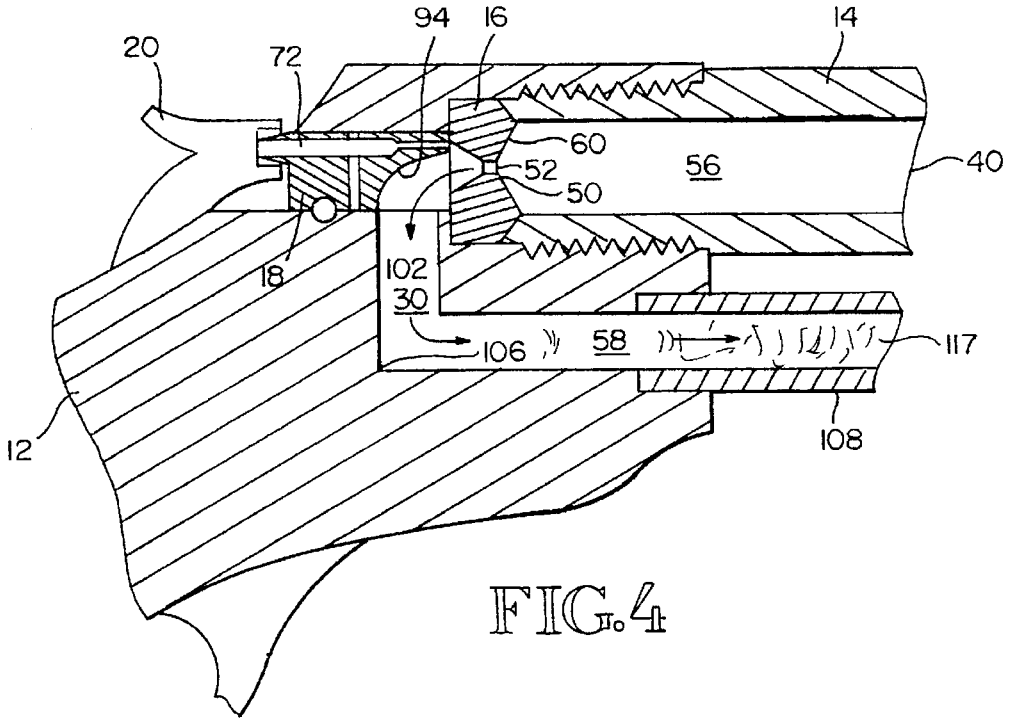
FIG. 4 is the cross-sectional view of FIG. 1 as the exhaust passage is emptied.

With reference to FIGS. 3 and 4, the inertia of the projectile 118, causes the back flash 58 to be directed rearward in the chamber 56 and funneled by the ignition locating bevel 60 into the front port 52 of the flash plate 16. The back flash 58 then passes through the flash passageway 50, exiting into the exhaust channel 30 of the receiver 12 through the rear port 54 of the flash plate 16.

With particular reference to FIG. 4, since the nipple 18 is offset with respect to the rear port 54 of the flash plate 16, the back flash 58 will be redirected downward and through the exhaust channel 30 rather than through the nipple. The arcuate concave surface 94 formed on the forward face 70 of the nipple 18 also tends to direct the back flash 58 downward and through the exhaust channel 30. In the rifle version, the second elbow 106 at the juncture of the exhaust channel 30 and the exhaust tube 108 directs the back flash 58 into a forward direction through the exhaust tube 108 and away from the shooter. The back flash 58 may then enter the exhaust chamber 117 for expansion to ensure that the back flash 58, has a lower temperature, pressure and velocity before it is safely expelled out of the first end 110 of the exhaust tube 108. The dissipated back flash 58 is preferably exhausted proximate the forward end 36 of the barrel into the direction that the barrel 14 is pointing in the rifle version (FIG. 4); and downward out of the lower end 28 of the receiver 12 in the pistol version of the invention (FIG. 6). These are preferred areas and directions for exhausting the backflash 58 without endangering the shooter.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

We claim:

1. A firearm which comprises:

a receiver having a forward end, a rearward end, an upper end, a lower end and an exhaust channel therein;

a barrel having a front end, a rear end and a longitudinal barrel bore therethrough for receiving a projectile, the barrel mounted proximate the rear end thereof to the receiver and extending forwardly therefrom;

a nipple having a rearward face, a forward face and an ignition passageway, the ignition passageway defining an input port on the rearward face and an output port on the forward face, the nipple mountable in the receiver such that the output port of the nipple opens into the exhaust channel of the receiver; and a flash plate having a front face, a rear face and a flash passageway, the flash passageway defining a front port on the front face and a rear port on the rear face, the flash plate received in the receiver between the rear end of the barrel and the nipple, the front port of the flash plate opening into the barrel bore proximate the rear end of the barrel and the rear port of the flash plate opening into the exhaust channel, the rear port of the flash plate staggered with respect to the output port of the nipple such that the rear port of the flash plate and the output port of the nipple are non-coaxial.

2. The firearm of claim 1 wherein the forward face of the nipple defines an arcuate concave surface in the exhaust channel.

3. The firearm of claim 1 wherein the forward face of the nipple has a slot defined therein, the slot defining an arcuate concave surface in the exhaust channel.

4. The firearm of claim 3 further comprising:

an exhaust tube having a convection coefficient greater than air, the exhaust tube having a first end, a second end and a longitudinal exhaust passage therethrough, the first end of the exhaust tube mounted to the receiver, the exhaust passage in communication with the exhaust channel.

5. The firearm of claim 3 wherein the rear face of the flash plate and the exhaust channel of the receiver form an elbow, the exhaust channel of the receiver extending relatively downward from the flash plate with respect to the receiver, the elbow having an included angle of at least 90 degrees.

6. The firearm of claim 5 further comprising:

an exhaust tube having a convection coefficient greater than air, the exhaust tube having a first end, a second end and a longitudinal exhaust passage therethrough, the first end of the exhaust tube mounted to the receiver, the exhaust passage in communication with the exhaust channel.

7. The firearm of claim 3 wherein the ignition output port of the nipple is spaced relatively above the rear port of the flash plate with respect to the receiver.

8. The firearm of claim 7 further comprising:

an exhaust tube having a convection coefficient greater than air, the exhaust tube having a first end, a second end and a longitudinal exhaust passage therethrough, the first end of the exhaust tube mounted to the receiver, the exhaust passage in communication with the exhaust channel; and an exhaust chamber is proximate the second end of the exhaust tube.

9. The firearm of claim 8 wherein an ignition locating bevel is defined on the front face of the flash plate concentric about the front port.

10. The firearm of claim 9 wherein an ignition directing bevel is defined on the rear face of the flash plate concentric about the rear port.

11. The firearm of claim 10 wherein a barrel sealing bevel is defined on the front face of the flash plate concentric about the ignition locating bevel, the barrel sealing bevel securingly engaged by the rear end of the barrel.

12. The firearm of claim 11 wherein the front face of the flash plate is formed of a malleable material.

13. The firearm of claim 12 further comprising a nipple retaining pin is securingly received through a pin receiving hole in the receiver and a pin receiving aperture in the nipple.

14. A firearm comprising a receiver having a forward end, a rearward end, an upper end and a lower end;

a barrel having a front end, a rear end and a longitudinal barrel bore therethrough, the rear end of the barrel mounted to the receiver, the barrel extending forward therefrom;

a flash plate having a front face, a rear face and a flash passageway extending through the front face and the rear face to define a front port on the front face and a rear port on the rear face, the flash plate received in the receiver, the front face of the flash plate proximate the rear end of the barrel;

a nipple having a rearward face, a forward face and an ignition passageway, the ignition passageway defining an input port on the rearward face and an output port on the forward face, the nipple mountable in the receiver relatively behind the rear face of the flash plate such that the output port of the nipple is not in coaxial alignment with the rear port of the flash plate; and an exhaust channel defined by the receiver such that the output port of the nipple and the rear port of the flash plate each open into the exhaust channel of the receiver.

15. The firearm of claim 14 wherein the forward face of the nipple defines an arcuate concave surface within the exhaust channel when the nipple is mounted in the receiver.

16. The firearm of claim 15 further comprising:

an exhaust tube having a convection coefficient greater than air, the exhaust tube having a first end, a second end and a longitudinal exhaust passage therethrough, the first end of the exhaust tube mounted to the receiver such that the exhaust passage opens into the exhaust channel of the receiver, the exhaust tube extending forwardly from the receiver.

17. The firearm of claim 14 wherein the forward face of the nipple has a slot formed therein, the slot defining an arcuate concave surface within the exhaust channel when the nipple is mounted in the receiver.

18. The firearm of claim 17 further comprising:

an exhaust tube having a convection coefficient greater than air, the exhaust tube having a first end, a second end and a longitudinal exhaust passage therethrough, the first end of the exhaust tube mounted to the receiver such that the exhaust passage opens into the exhaust channel of the receiver, the exhaust tube extending forwardly from the receiver; and an exhaust chamber defined proximate the second end of the exhaust tube.

19. A method of firing a firearm, the firearm having a receiver having a forward end and a rearward end, a barrel mounted to the receiver at the rearward end thereof, the receiver having an exhaust channel, a flash plate received within the receiver, the flash plate having a front port opening to a rear end of the barrel, the flash plate having a rear port opening into the exhaust channel and a flash passage connecting the front port and the rear port, a nipple, the nipple having an input port, an output port opening into the exhaust channel, and an ignition passageway extending between the input port and the output port, the nipple mounted in the receiver such that the output port of the nipple is not coaxially aligned with the rear port of the flash plate, the firing method comprising the steps of:

striking an ignition cap mounted proximate the input port of the nipple;

directing an ignition spark through the ignition passageway of the nipple;

directing the ignition spark into the flash passageway of the flash plate;

directing the ignition spark into a powder charge contained in the barrel;

igniting the powder charge to project a projectile out of the barrel;

directing a back flash from the front port of the flash plate to the rear port thereof through the flash passageway;

deflecting the back flash away from the output port of the nipple;

directing the back flash over an arcuate concave surface to produce a relatively low pressure in an exhaust channel; and expelling the back flash through the exhaust channel.

20. The method of firing a firearm of claim 19 further comprising the step of:

cooling the back flash by passing the back flash through an exhaust tube before expelling the back flash out of the firearm, the exhaust tube defining an exhaust passage therethrough and an exhaust chamber having a cross-sectional area greater than a cross-sectional area of the exhaust passage, the exhaust tube further having a convection coefficient greater than air.

* * * * *